US007956321B2

(12) United States Patent
Murayama et al.

(10) Patent No.: US 7,956,321 B2
(45) Date of Patent: Jun. 7, 2011

(54) METHOD OF MEASURING TARGET OBJECT IN A SAMPLE USING MASS SPECTROMETRY

(75) Inventors: Yohei Murayama, Tokyo (JP); Manabu Komatsu, Kawasaki (JP); Hiroyuki Hashimoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 12/239,344

(22) Filed: Sep. 26, 2008

(65) Prior Publication Data

US 2009/0026364 A1 Jan. 29, 2009

Related U.S. Application Data

(63) Continuation of application No. 11/283,912, filed on Nov. 22, 2005, now Pat. No. 7,446,309.

(30) Foreign Application Priority Data

Nov. 25, 2004 (JP) ..... 2004-340565

(51) Int. Cl.
*H01J 49/00* (2006.01)

(52) U.S. Cl. ..... 250/282; 250/281; 250/307; 250/283; 250/306; 250/492.1; 436/173

(58) Field of Classification Search ..... 250/282, 250/281, 307, 283, 306; 435/6, 7.1, 68.1
See application file for complete search history.

(56) References Cited

U.S. PATENT DOCUMENTS 5,679,539 A * 10/1997 Hudson et al. ..... 435/68.1
5,894,063 A 4/1999 Hutchens et al.
6,319,674 B1 * 11/2001 Fulcrand et al. ..... 435/7.1
6,610,479 B1 * 8/2003 Lundeberg et al. ..... 435/6
6,670,190 B2 12/2003 Gardella et al.
7,446,309 B2 * 11/2008 Murayama et al. ..... 250/282

(Continued)

FOREIGN PATENT DOCUMENTS

JP 2004-085546 A 3/2004

(Continued)

OTHER PUBLICATIONS

Heinrich F. Arlinghaus et al.,"Analysis of Biosensor Chips for Identification of Nucleic Acids," 69(18) Anal. Chem. 3747-3753 (Sep. 1997).

(Continued)

*Primary Examiner* — Robert Kim
*Assistant Examiner* — Johnnie L Smith
(74) *Attorney, Agent, or Firm* — Fitzpatrick, Cella, Harper & Scinto

(57) ABSTRACT

In-plane distribution of a target object contained in a sample is measured. The sample dispersedly placed on a substrate is treated to promote ionization of the target object. Then, the mass and flying amount of an ion containing the target object or a component thereof is determined by irradiating an ion beam to the sample and performing time-of-flight secondary ion mass spectrometry of the ion that flies from a portion in the sample where the ion beam is irradiated, and the in-plane distribution of the target object is determined from the mass and flying amount data obtained at plural portions by scanning the beam on the sample plane. The step of treating the sample to promote ionization of the target object includes contacting an aqueous solution of an acid that does not crystallize at ordinary temperature with the sample. A high spatial resolution two-dimensional image can be obtained.

10 Claims, 6 Drawing Sheets

U.S. PATENT DOCUMENTS

| | | | |
|---|---|---|---|
| 2002/0121595 | A1 | 9/2002 | Sunner et al. |
| 2003/0008404 | A1 | 1/2003 | Tomita et al. |
| 2003/0207462 | A1 | 11/2003 | Kitagawa |
| 2003/0218130 | A1 | 11/2003 | Boschetti et al. |
| 2004/0137491 | A1 | 7/2004 | Okamoto et al. |
| 2004/0232330 | A1 | 11/2004 | Uenishi et al. |
| 2006/0147913 | A1 | 7/2006 | Okamoto |
| 2006/0211106 | A1 | 9/2006 | Komatsu et al. |
| 2007/0042496 | A1 | 2/2007 | Okamoto et al. |

FOREIGN PATENT DOCUMENTS

| | | | |
|---|---|---|---|
| WO | 94/28418 | A1 | 12/1994 |
| WO | 97/09608 | A1 | 3/1997 |
| WO | 99/22399 | A2 | 5/1999 |
| WO | 03/034024 | A2 | 4/2003 |

OTHER PUBLICATIONS

Kuang Jen Wu et al., "Matrix-Enhanced Secondary Ion Mass Spectrometry: A Method for Molecular Analysis of Solid Surfaces," 68 Anal. Chem. 873-82 (1996).

Anna M. Belu et al. "Enhanced TOF-SIMS Imaging of a Micropatterned Protein by Stable Isotope Protein Labeling," 73 Anal. Chem. 143-50 (2001).

David S. Mantus et al., "Static Secondary Ion Mass Spectrometry of Adsorbed Proteins," 65 Anal. Chem. 1431-38 (1993).

Matthew S. Wagner et al., "Light of Detection for Time of Flight Secondary Ion Mass Spectrometry (ToF-SIMS) and X-Ray Photoelectron Spectroscopy (XPS): Detection of Low Amounts of Adsorbed Protein," 13 J. Biomater. Sci. Polymer Edn. 407 (2002).

* cited by examiner

METHOD OF MEASURING TARGET OBJECT IN A SAMPLE USING MASS SPECTROMETRY

This application is a continuation of application Ser. No. 11/283,912, filed Nov. 22, 2005, which is incorporated herein by reference.

BACKGROUND OF THE INVENTION

1. Field of the Invention

The present invention relates to a method of acquiring information about a target object using a time-of-flight secondary ion mass spectrometer and to an imaging detection method based on the type of a constituent of the target object, in particular, an organic substance, such as a protein.

2. Related Background Art

With the recent developments in genomic analyses, it has become important to analyze proteins, which are gene products that exist in a living body, in particular, a protein tip. Also, a technology for visualizing a distributed protein present in, e.g., living tissue, has become important.

Conventionally, the importance of analyses of protein expressions and functions has been indicated, and the development of the analysis means is proceeding. Basically, this has been performed by combining:

(1) separation and purification by two-dimensional electrophoresis or high-performance liquid chromatography (HPLC); and (2) a detection system, such as radiation analysis, optical analysis, or mass spectrometry.

The developments of protein analysis technologies mainly include: database construction by proteome analyses that are bases for the technologies (exhaustive analyses of intracellular proteins); and diagnostic devices or drug discovery (candidate drug screening) devices based on the obtained database. For all application forms, there have been required devices that are different from the conventional devices, which have problems with analyzing time, throughput, sensitivity, resolution, and flexibility, and that are suitable for miniaturization, speed enhancement, or automatization. As a means for meeting those requirements, development of a device in which a protein is integrated at a high density (so-called protein tip) has attracted attention.

A target molecule captured by a protein tip may be detected by the following various detection means.

In recent years, in mass spectrometry (MS) protein detection, time-of-flight secondary ion mass spectrometry (hereinafter abbreviated as TOF-SIMS) has been used as a sensitive mass analysis means or surface analysis means. The TOF-SIMS is a method of analyzing what atoms or molecules are present on the outermost surface of a solid sample and has the following characteristics. That is, it has an ability to detect ultratrace ($10^9$ atoms/cm$^2$) components, can be applied to both organic substances and inorganic substances, enables a measurement of all elements or compounds that are present on the surface, and enables imaging of secondary ions from a substance that is present in the surface of a sample.

The principle of the method are briefly described below.

When high-speed pulsed ion beams (primary ions) are irradiated onto the surface of a solid sample at a high vacuum, a component of the surface is released into the vacuum by a sputtering phenomenon. The generated positively or negatively-charged ions (secondary ions) are focused in one direction by an electrical field, and detection is performed at a remote position. When pulsed primary ions are irradiated onto the solid surface, secondary ions having various masses are generated depending on the composition of the surface of the sample. Among the secondary ions, an ion having a smaller mass flies faster than an ion having a larger mass. Therefore, a measurement of a time between generation and detection of the secondary ions (flight time) enables the analysis of masses of the generated secondary ions to be performed. When primary ions are irradiated, only secondary ions generated at the outermost surface of a solid sample are released into the vacuum, so that information about the outermost surface (depth: about a few nm) of the sample can be obtained. In the TOF-SIMS, the amount of irradiated primary ions is significantly small, so that an organic compound is ionized while maintaining its chemical structure, and the structure of the organic compound can be identified from the mass spectra. However, when the TOF-SIMS analysis is performed for an artificial polymer, such as polyethylene or a polyester, a biological polymer, such as a protein, or the like, under typical conditions, small degraded fragment ions are generated, so that it is generally difficult to identify the original structure. Meanwhile, when the solid sample is an insulator, the insulator can be analyzed because positive charges accumulated on the solid surface can be neutralized by irradiating pulsed electron beams at the time when pulsed primary ions are not irradiated. In addition, the TOF-SIMS enables the measurement of an ion image (mapping) of the surface of a sample by scanning primary ion beams.

As examples of protein analyses by the TOF-SIMS, the followings are known: detection of a protein parent molecule having a large molecular weight by applying the same pretreatment as the MALDI method, that is, by mixing a protein with a matrix substance (Kuang Jen Wu et al., Anal. Chem., 68, 873 (1996)); imaging detection of a certain protein using secondary ions, such as $C^{15}N^-$, after labeling a part of the protein of interest with an isotope, such as $^{15}N$ (A. M. Belu et al., Anal. Chem., 73, 143 (2001)); estimation of the kinds of proteins from the kinds of fragment ions (secondary ions) corresponding to amino acid residues or the relative intensities of the fragment ions (D. S. Mantus et al., Anal. Chem., 65, 1431 (1993)); research of the detection limits of the TOF-SIMS for proteins adsorbed on various substrates (M. S. Wagner et al., J. Biomater. Sci. Polymer Edn., 13, 407 (2002)); etc.

Meanwhile, as another mass spectrometry method for proteins, a method utilizing field emission (WO 99/22399) is known. In this method, the above-described proteins are covalently or coordinately bound on a metallic electrode via a cleavable releasing group depending on applied energy and an intense electric field is applied to thereby lead the above-described proteins to a mass spectrometer.

As described above, for a target object in which plural proteins are dispersed, various methods based on the mass spectrometry have been suggested as methods of analyzing the distribution state of the proteins.

However, conventional mass spectrometry methods are not intended to analyze a target object itself and the resultant information is limited because the methods are directed to an eluted protein or the like. Meanwhile, when mass spectrometry was performed by these methods, it was not possible to directly estimate nonspecific adsorption on the tip surface.

Meanwhile, among ionization methods known today, the MALDI method or the SELDI method, which is an improved method thereof, is the softest ionization method and has an excellent feature in that it enables ionization of a protein that has a large molecular weight and is easily broken without any additional treatment and enables detection of parent ions or ions based thereon. This method is one of standard ionization methods for analyzing the mass of a protein. However, when those methods are applied to the mass spectrometry with a protein tip, it is difficult to obtain a high spatial resolution two-dimensional distribution image (imaging using mass information) of a protein due to the presence of a matrix substance. That is, a laser beam itself, which is an excitation source, can be easily condensed to a diameter of about 1 to 2 μm, but the matrix substance that exists around the protein to be analyzed is evaporated and ionized, so that the spatial resolution is generally about 100 μm when the two-dimensional protein distribution image is measured by the above-described method. Meanwhile, a complex operation for a lens or mirror is required to scan the condensed laser. That is, when a two-dimensional distribution image of a protein is measured by the method, scanning of a laser beam is generally difficult, and there may be employed a system to move a sample stage where a sample to be analyzed is placed. When an attempt is made to obtain a high spatial resolution two-dimensional distribution image of a protein, the system to move the sample stage is generally not preferable.

Moreover, it is difficult to provide a two-dimensional distribution image of a target object by conventional methods, and there are limitations in the forms of target samples.

Compared with the above-described methods, the TOF-SIMS method enables easy focusing and scanning because of the use of primary ions. Therefore, the method may provide high spatial resolution secondary ion images (two-dimensional distribution images) and also provide a spatial resolution of about 1 μm. However, when the TOF-SIMS measurement is performed for a target object on a substrate under typical conditions, most of the generated secondary ions are small degraded fragment ions, so that it is generally difficult to identify the original structure. Therefore, for a sample such as a protein tip produced by arranging plural proteins on a substrate, ingenuity is required to obtain high spatial resolution secondary ion images (two-dimensional distribution images) that enable identification of the kind of the proteins of interest. The above-described method by Kuang Jen Wu et al., is a method that enables suppression of degradation of proteins having large molecular weights due to irradiation of primary ions and detection of a parent molecule while maintaining the original mass. However, in this method, a mixture of proteins and a matrix substance is used as a sample to be measured. Therefore, when a sample, such as the above-described protein tip, is analyzed, it is impossible to obtain the original two-dimensional distribution information. Meanwhile, the method by A. M. Belu et al., includes labeling a part of a certain protein with an isotope and is a method that enables sufficient exertion of a high spatial resolution of the TOF-SIMS. However, the labeling of a specific protein with an isotope each time is not general. Meanwhile, in the method shown by D. S. Mantus et al., which is a method of estimating the kinds of proteins from the kinds of fragment ions (secondary ions) corresponding to amino acid residues or relative intensities of the fragment ions, it is difficult to identify the kinds in the case where proteins having similar amino acid compositions exist in a mixture.

Meanwhile, when the TOF-SIMS method is applied to, e.g., a protein molecule in body tissue, the generation efficiencies of secondary ion species are significantly decreased if the "holding state" of a peptide chain of the protein molecule is maintained. In measurement using the TOF-SIMS method, a sample to be measured is preliminarily subjected to a drying treatment to perform irradiation of primary ions in a high vacuum. In the drying treatment, an interaction occurs between a protein molecule present in the body tissue and another biological substance, and aggregation is caused by intermolecular association, resulting in a further decrease in the secondary ion generation efficiency.

Therefore, before performing two-dimensional imaging for the abundance distribution of a certain protein molecule in a cutting surface of a body tissue by analyzing the abundance of the certain protein molecule present in the body tissue at high detection sensitivity and high quantification accuracy, it is preferable to preliminarily loosen a peptide chain that constitutes the protein molecule in the "holding state". Moreover, it is preferable to maintain a state where secondary ion species are generated at a high efficiency from an "unholding" peptide chain by suppressing the interaction between a protein molecule and another biological substance. Alternatively, it is preferable to promote or increase generation of secondary ion species from a protein molecule existing in a cutting surface of the body tissue.

Meanwhile, in the TOF-SIMS method, ion sputtering is performed by irradiating primary ions to a molecule to be analyzed, but a difference is caused in the sputtering efficiencies depending on the shape of the surface to be irradiated by the primary ions. As a result, a difference is also caused in the generation efficiencies of secondary ion species derived from the molecule to be analyzed, which may be a trigger of a variation in the quantification accuracy. Therefore, it is preferable to also suppress the variation in the generation efficiencies of secondary ion species caused by variation of the shapes of the surfaces to be irradiated by the primary ions. However, conventionally disclosed methods are not necessarily sufficient in those regards.

SUMMARY OF THE INVENTION

An object of the present invention is to solve the aforementioned problems. The present invention relates to a method of acquiring information from a target object. It provides a method of acquiring information to obtain a high spatial resolution two-dimensional distribution image by type of the target object using the TOF-SIMS.

According to the present invention, there is provided a method of measuring in-plane distribution of a target object contained in a sample that is dispersedly placed on a substrate, which includes the steps of: treating the sample to promote ionization of the target object; determining the mass and flying amount of an ion containing the target object or a component of the target object by irradiating an ion beam to the sample and performing time-of-flight secondary ion mass spectrometry of the ion that flies from a portion in the sample where the ion beam is irradiated; and determining the in-plane distribution of the target object from measurement data obtained by the step of determining the mass and flying amount of the ion at plural portions by scanning the beam on the sample plane, wherein the step of treating the sample to promote ionization of the target object includes a step of contacting an aqueous solution of an acid that does not crystallize at an ordinary temperature with the sample.

A treatment for attaching a sensitizing substance to a target object of a present invention enables effective generation of a parent molecule ion of a constituent of the target object in the TOF-SIMS analysis and enables imaging detection while maintaining the two-dimensional distribution state of the constituent.

BRIEF DESCRIPTION OF THE DRAWINGS

FIG. 1A shows an actual spectrum (wide area); FIG. 1B shows an actual spectrum of

[(insulin)+(H)]$^{+}$; FIG. 1C shows an actual spectrum of [(insulin)+(2H)]$^{2+}$; FIG. 1D shows a theoretical spectrum of [(insulin)+(H)]$^{+}$ calculated from the isotope abundance; and FIG. 1E shows images obtained by using the resultant secondary ion mass spectra.

DESCRIPTION OF THE PREFERRED EMBODIMENTS

Figure 1A:
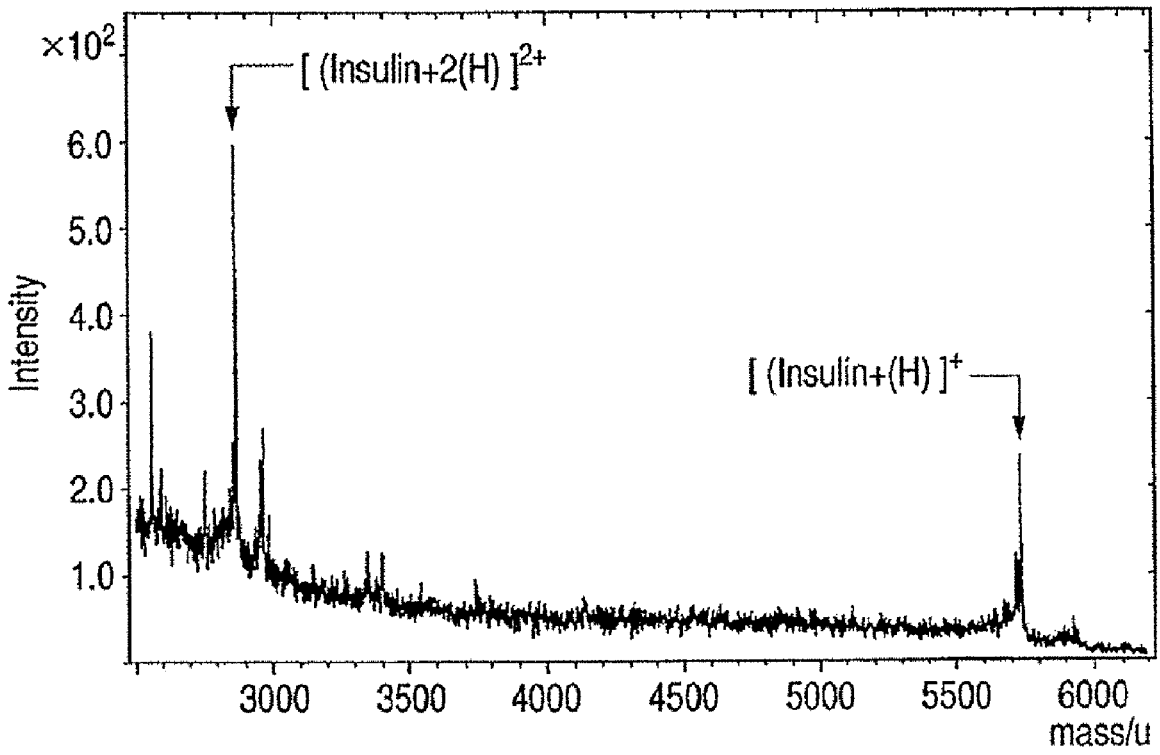
FIGS. 1A, 1B, 1C, 1D and 1E each show positive secondary ion mass spectrum in Example 1.

Hereinafter, the embodiments of the present invention will be described in more detail.

The present invention is characterized in that a target object is flown using a substance to promote ionization of the target object, to thereby obtain information about the mass of a secondary ion capable of identifying the above-described flying target object. Moreover, the present invention is characterized by enabling detection (imaging) of the two-dimensional distribution state of the target object obtained by scanning of primary ions. Laser beams may be used as primary beams for ionization of the target object to fly the target object. To improve the resolution, suitable are ions, neutrons, electrons, etc., which are capable of being focused, pulsed, and scanned.

In the present invention, efficiency in generation of secondary ion species derived from a protein molecule existing in the sample surface may be improved by reacting a solution containing a sensitizing substance with the surface. The sensitizing substance is one that shows a function to promote/increase generation of secondary ion species derived from a protein molecule present in the surface when primary ions are irradiated. For example, when a dilute acidic aqueous solution is used as the solution containing a sensitizing substance, the dissociated acid in the aqueous solution reacts with a protein molecule to cancel the "holding state" of a peptide chain that constitutes the protein molecule, resulting in promotion of generation of secondary ion species. As described above, in the present invention, a sensitizing substance itself or a component of the sensitizing substance reacts with a protein molecule to thereby lead to a state where a tangle of a protein is loosened. Examples of the sensitizing substance to be used in the present invention include trifluoroacetic acid or the like.

Meanwhile, the substance to promote ionization of the target object of the present invention is:

(1) attached after the target object is arranged on a substrate;

(2) preliminarily attached to one or plural kinds of specific target objects arranged on a substrate; or (3) preliminarily attached on the surface of a substrate before the target object is arranged on the substrate.

Among the above, system (1) is a system that may be applied to the analyses of target objects having any shape, i.e., it is a versatile system. However, when attaching a substance to promote ionization of a target object that is two-dimensionally distributed on a substrate, attention needs to be paid so as not to diffuse the target object by the treatment for attaching the substance. The reason is that a target object of the present invention cannot be achieved when the two-dimensional distribution state of the target object is changed by the treatment for attaching the substance. For example, a comparison with the results of a TOF-SIMS analysis for a protein tip that has not been subjected to the same treatment enables judgment whether the two-dimensional distribution state of the target object has varied.

System (2) is intended to preliminarily attach, to a specific target object, a substance (sensitizing substance) to promote ionization of the target object to increase sensitivity in a TOF-SIMS analysis. The system has an advantage in that the two-dimensional distribution state of the specific target object may be selectively and sensitively detected. However, the system has a disadvantage in that a preliminary attachment treatment or the like must be performed for each target object, resulting in requiring somewhat cumbersome operations.

System (3) is intended to promote ionization of a target object and to preliminarily form a substance (sensitizing substance) to increase sensitivity in a TOF-SIMS analysis on the surface of a substrate. For the system, it is important to sufficiently research whether a new problem of nonspecific adsorption is caused due to the presence of the sensitizing substance. The sensitizing substance is not particularly limited as long as it increases sensitivity in a TOF-SIMS analysis. That is, it may have an effect on enhancing the ionization efficiency of the target object in a process for generating secondary ions in the TOF-SIMS analysis. Furthermore, the sensitizing substance is preferably formed on the outermost surface of a substrate, but in order to prevent nonspecific adsorption, another substance having a thickness of about a monomolecular film may be arranged on the sensitizing substance.

As described above, the treatment to promote ionization according to the present invention is an effective treatment to enhance the ionization efficiency of a target object, such as a protein, in a process for generating secondary ions in a TOF-SIMS analysis. In the present invention, therefore, a substance containing an acid is used as a sensitizing agent.

Preferable examples of the acid in accordance with the present invention include trifluoroacetic acid, hydrochloric acid, nitric acid, hydrofluoric acid, acetic acid, or formic acid. Trifluoroacetic acid is particularly preferable. However, another acid may be used as long as it has the above-described effect. Meanwhile, to dissociate hydrogen ions in an aqueous solution at a sufficient concentration and attach the hydrogen ions to target objects, the pH is preferably 6.0 or less.

Meanwhile, when the aforementioned attachment treatment is utilized for a protein that is two-dimensionally distributed on a substrate without changing the two-dimensional distribution state, attention needs to be paid so as not to diffuse the protein. A sensitizing substance may be easily attached in a single treatment step by gently dropping the aforementioned aqueous solution on a site where a protein is arranged without changing the two-dimensional distribution state. Specific examples of the attachment treatment include an attachment treatment performed by dropping a droplet discharged from a pipetter or inkjet printer onto a target object and an attachment treatment performed by immersing a target object in an aqueous solution. Those treatments enable the measurement of the distribution at a high accuracy without significantly changing the two-dimensional distribution state of a target object. The attachment treatment of the sensitizing substance is not limited to those methods, and any method may be used as long as it enhances ionization efficiency of secondary ions of a target object in a TOF-SIMS analysis and does not change in the two-dimensional distribution state of the target object.

Moreover, it is preferable that the original distribution in a sample not be changed even after the treatment to promote ionization. Therefore, the above-described substance containing an acid is preferably volatilized after completion of the reaction to promote ionization of a target object. The substance is required not to crystallize, to be in a liquid state at least at room temperature, and to vaporize by subsequent drying. All of the above-described acids meet those requirements.

In the present invention, to improve the accuracy of the distribution measurement, ions are used as excitation beams for ionization of a target object to fly. Therefore, in the present invention, it is not necessary for the above-described substance containing an acid to be crystallized and become a matrix material for a protein. Even if the substance containing an acid remains in a sample, the mass spectrum of the acid does not correspond to that of the target object because each of the above-listed acids has a relatively low molecular weight. Meanwhile, all the above-listed acids have no aromatic rings and hardly absorb laser beams, such as nitrogen laser beams, so that extra ions are not generated even when the laser beams are used as excitation beams.

In the present invention, a substrate where a protein to be analyzed is arranged is preferably a gold substrate or a substrate obtained by applying a gold film onto the surface of the substrate. However, it is not particularly limited and may be applied to a protein tip including a conducting substrate, such as a silicon substrate, and an insulating substrate, such as an organic polymer or glass, as long as the substance of the substrate generates no secondary ion that has mass to prevent obtaining mass information of the protein. Furthermore, a media where a protein to be analyzed is arranged is not limited by the shape of the substrate, and there may be used solid substances having any shape, such as powder and granular shapes.

Information about the mass of a target object or a component thereof in the present invention is the information about the mass of either:

(1) an ion corresponding to the mass number of an ion generated by getting or losing 1 to 10 atoms selected from the following elements: hydrogen, carbon, nitrogen, and oxygen (including a combination of plural elements) for the target object itself (parent molecule); or (2) an ion corresponding to the mass number of an ion generated by attaching at least one of noble metal atoms such as Ag and Au and alkaline metal atoms, such as Na and K, and getting or losing 1 to 10 atoms selected from the following elements: hydrogen, carbon, nitrogen, and oxygen (including a combination of plural elements) for the target object itself (parent molecule). That is, the information may be obtained by detecting a secondary ion corresponding to the mass number of an ion generated by getting or losing any atom to a parent molecule.

The present invention enables acquisition of information about the two-dimensional distribution state of the target object obtained by scanning primary beams based on detection of the flying ions.

The detection (imaging) of the two-dimensional distribution state of a target object in the present invention is characterized by using secondary ions capable of identifying the target object. Each of the secondary ions is preferably an ion having a mass/charge ratio of 500 or more, more preferably an ion having a mass/charge ratio of 1,000 or more.

Meanwhile, as primary ion species, from the viewpoint of ionization efficiency, mass resolution, etc., there is suitably used a gallium or cesium ion, or, in some cases, a metal, such as a gold (Au) ion, so that it is easy to form a cluster ion. The cluster metallic ion is preferable because its use enables an extremely sensitive analysis. The ion may be a polyatomic ion of gold, and $Au_2$ or $Au_3$ ion may be used. The sensitivity is often more improved by those ions in that order, and utilization of a polyatomic ion of gold is more preferable.

In addition, the pulse frequency of primary ion beams is preferably in the range of 1 kHz to 50 kHz. Meanwhile, the energy of primary ion beams is preferably in the range of 12 keV to 25 keV, and the pulse width of primary ion beams is preferably in the range of 0.5 ns to 10 ns.

Meanwhile, for the purpose of improving accuracy in quantification in the present invention, the measurement must be completed in a relatively short time (from several tens of seconds to several tens of minutes per measurement) while maintaining high mass resolution, so that the measurement is preferably performed with little regard for the diameter of each primary ion beam. Specifically, the diameter of each primary ion beam is not reduced to a submicron order and is preferably set in the range of 1 μm to 10 μm.

EXAMPLES

Hereinafter, the present invention is described more specifically by way of examples. The specific examples shown below are examples of the best embodiments according to the present invention, but the present invention is not limited to the specific embodiments.

Example 1

Spotting of Protein and TFA Treatment on Au/Si Substrate and TOF-SIMS Analysis As a substrate, there was used a substrate obtained by washing a silicon (Si) substrate containing no impurities with acetone and deionized water in that order and forming a gold (Au) film (100 nm) thereon. A 10 μM aqueous solution of bovine insulin ($C_{254}H_{377}N_{65}O_{75}S_6$ (the average molecular weight: 5729.60, the mass of a molecule including elements having a highest isotope abundance: 5733.57), hereinafter referred to as insulin) purchased from the Sigma Corporation was prepared with deionized water. The aqueous solution was spotted onto the aforementioned Au-coated Si substrate using a micropipetter. The thus-prepared substrate was air-dried, and then a 0.1 mass % trifluoroacetic acid (TFA) aqueous solution was spotted again onto the position where the insulin aqueous solution had been spotted using a micropipetter. The substrate was air-dried and then used for a TOF-SIMS analysis. In the TOF-SIMS analysis, a TOF-SIMS type IV instrument (manufactured by ION-TOF) was used. The measurement conditions are summarized below.

Primary ion: 25 kV $Ga^+$, 2.4 pA (pulse current value), saw tooth scan mode

Pulse frequency of primary ion: 3.3 kHz (300 μs/shot)

Pulse width of primary ion: about 0.8 ns

Diameter of primary ion beam: about 3 μm

Measurement region: 300 μm×300 μm

Pixel number of secondary ion image: 128×128

Integration time: about 400 seconds

Figure 1B:
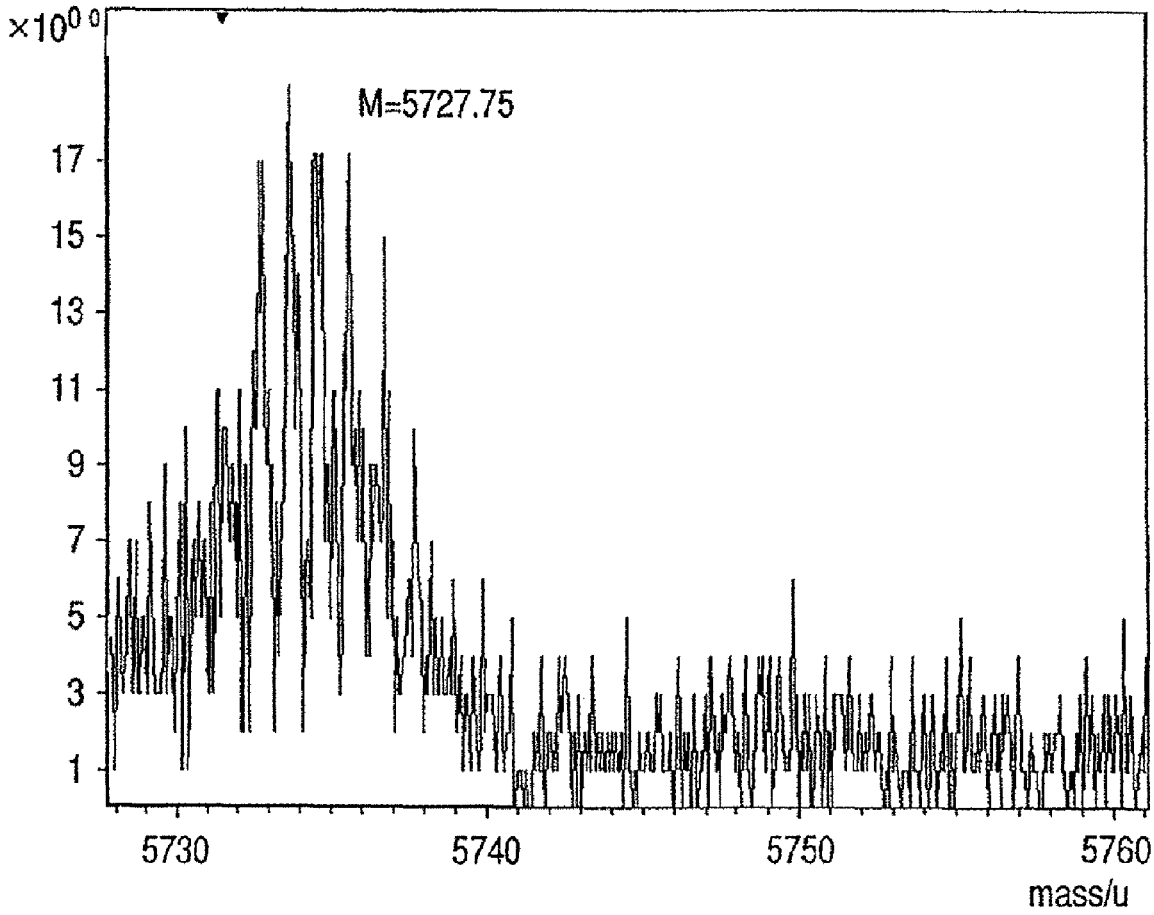
Figure 1C:
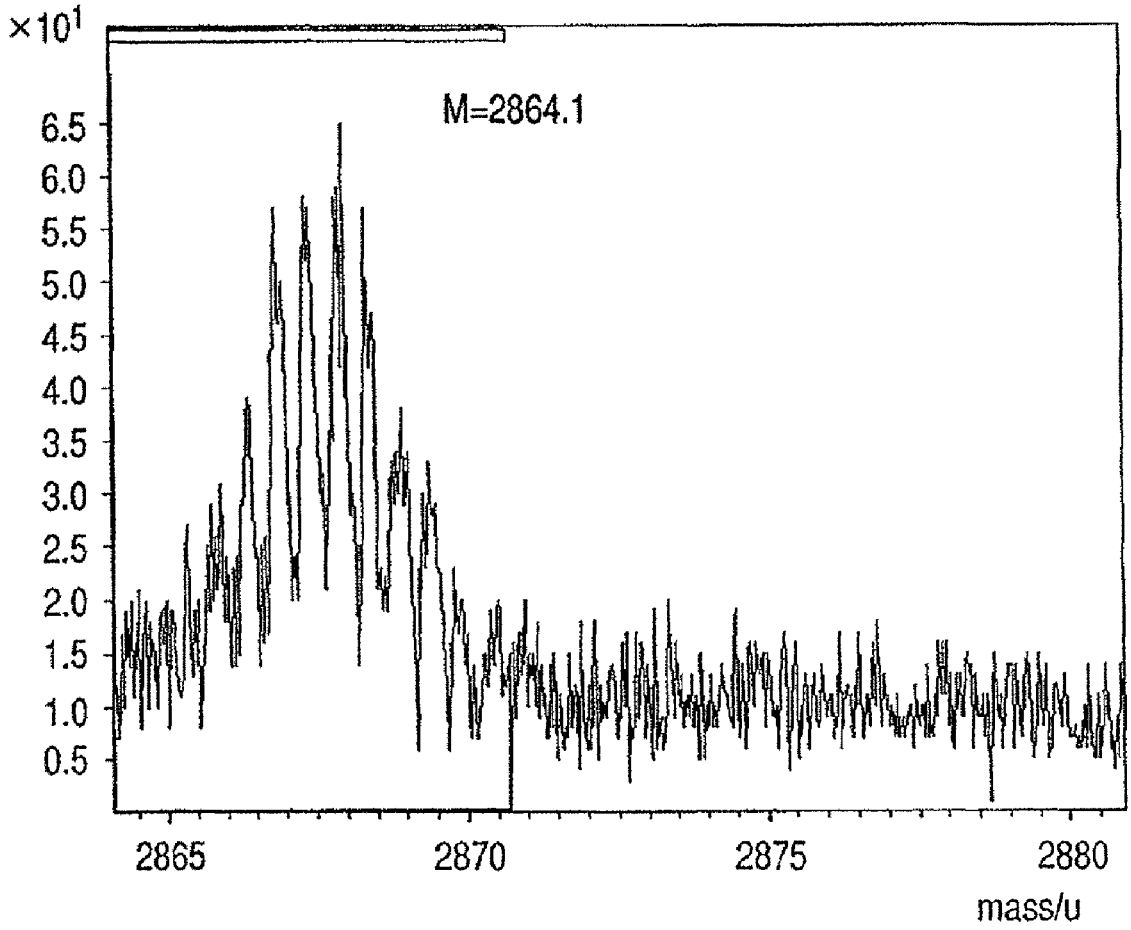
Figure 1D:
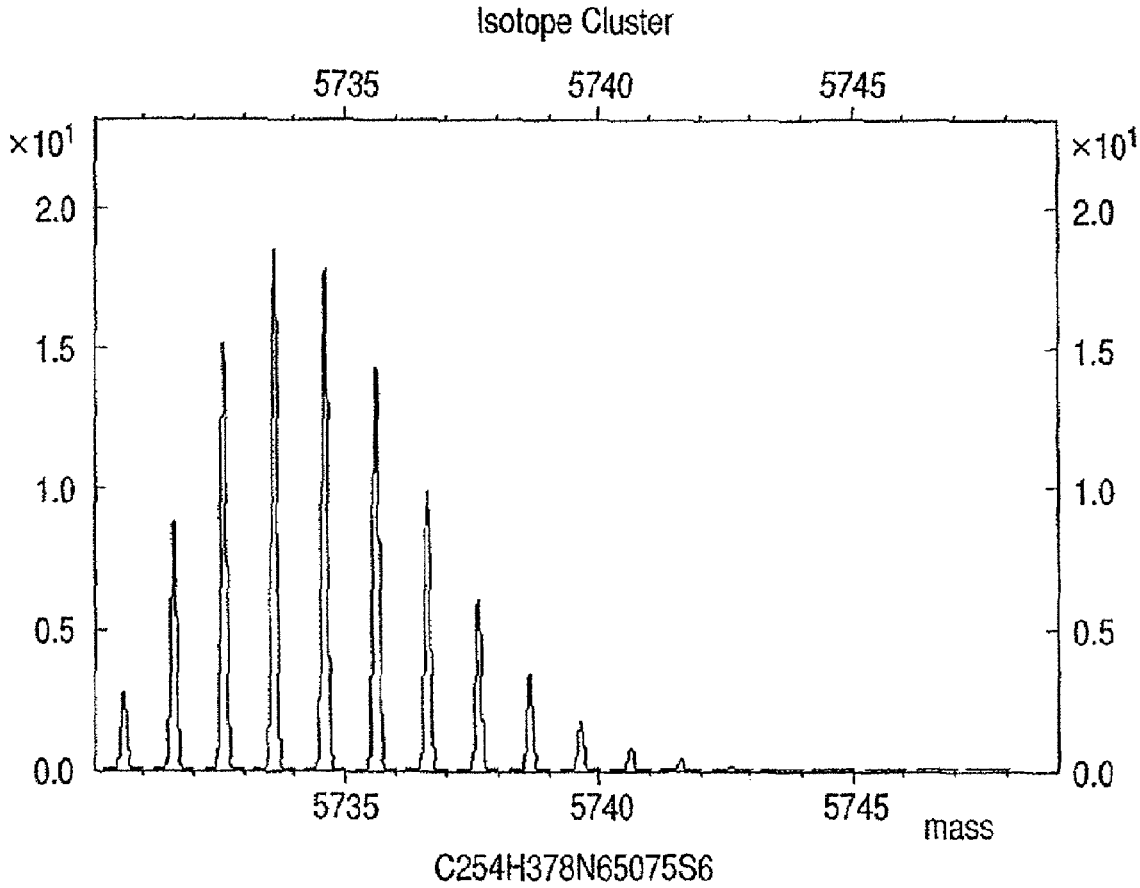

Under such conditions, positive and negative secondary ion mass spectra were measured. As a result, in the positive secondary ion mass spectrum, there were detected secondary ions corresponding to the masses of ions generated by attaching one and two hydrogen atoms to parent molecules of insulin. FIG. 1A shows the enlarged view of spectra in this region; FIG. 1B shows the enlarged view of the $[(\text{insulin})+(H)]^+$ ion in FIG. 1A, which have been generated by attaching one hydrogen atom to an insulin molecule; and FIG. 1C shows the enlarged view of the $[(\text{insulin})+(2H)]^{2+}$ ion in FIG. 1A, which have been generated by attaching two hydrogen atoms to an insulin molecule. In addition, FIG. 1D shows a theoretical spectrum calculated from the isotope abundance.

Figure 1E:
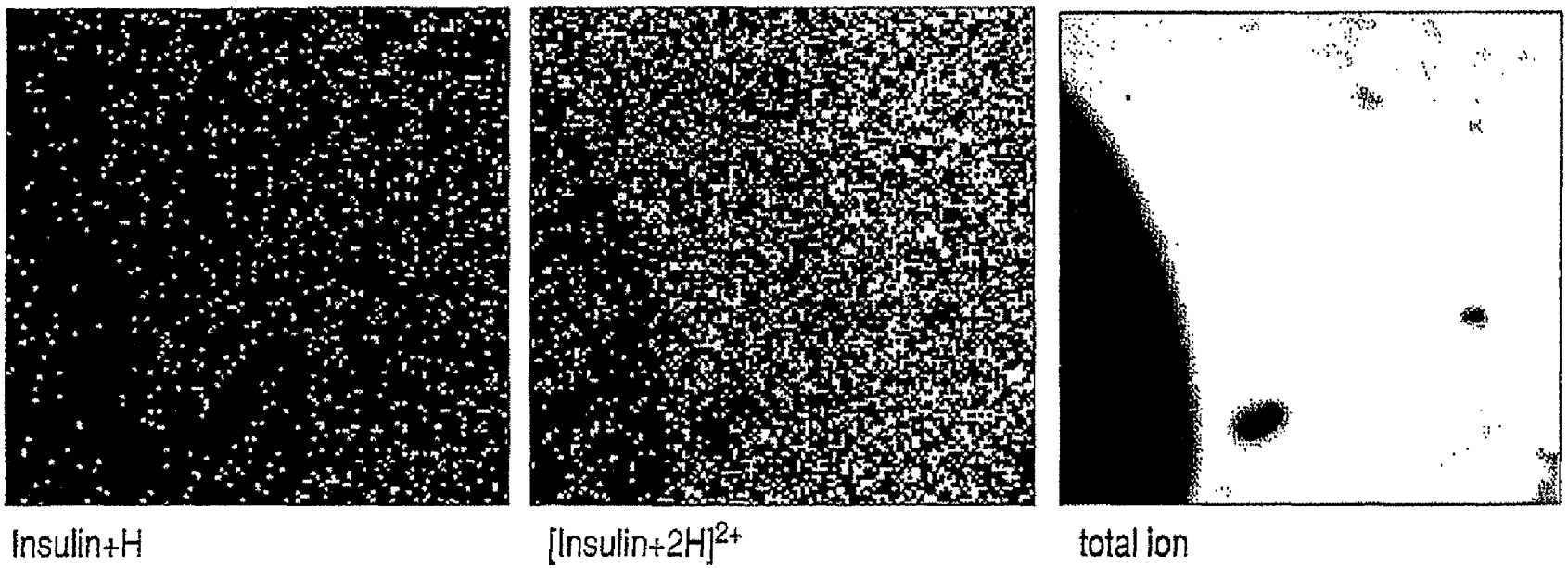

In FIG. 1A, the peaks indicated by the arrows correspond to the above-described ions, $[(\text{insulin})+(H)]^+$ and $[(\text{insulin})+(2H)]^{2+}$, and the m/z values of those ions were found to be approximately the same as the theoretical value of $[(\text{insulin})+(H)]^+$ (5734.58) and the theoretical value of $[(\text{insulin})+(2H)]^{2+}$ (5735.58/2=2867.79). Meanwhile, for $[(\text{insulin})+(H)]^+$, the shape of the actual spectrum in FIG. 1B was found to be approximately the same as that of the theoretical spectrum in FIG. 1D. Moreover, use of those secondary ions based on the parent ions of insulin enables obtaining a two-dimensional image that reflects the two-dimensional distribution state of insulin. FIG. 1E show the two-dimensional images. In FIG. 1E, the brighter regions show greater ion strength, and the image also revealed the distribution state of insulin.

Comparative Example 1

Figure 2:
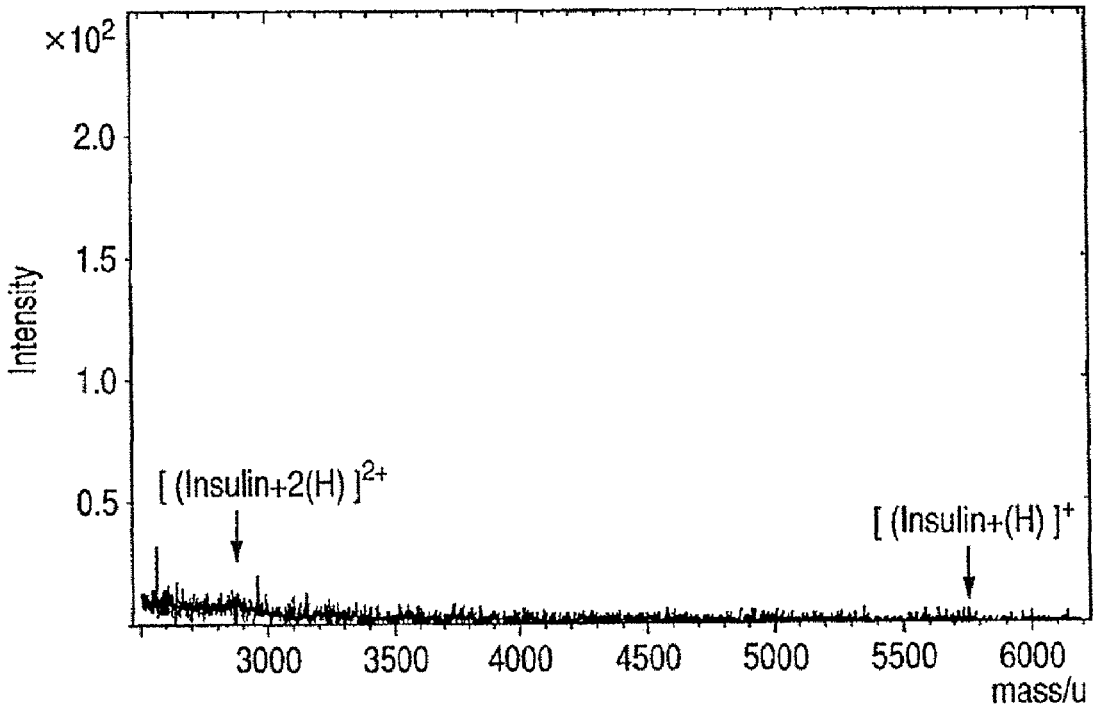
FIG. 2 shows a positive secondary ion mass spectrum in Comparative Example 1.

Spotting of Peptide on Au/Si Substrate (No TFA Treatment) and TOF-SIMS Analysis In a manner similar to that described in Example 1, an insulin aqueous solution was spotted on an Au-coated Si substrate. The substrate was air-dried and then used for a TOF-SIMS analysis without spotting a 0.1 mass % TFA aqueous solution. Under the same conditions as those in Example 1, positive and negative secondary ion mass spectra were measured. As a result, in the positive secondary ion mass spectrum, peaks based on parent ions of insulin as observed in Example 1 were not observed as shown in FIG. 2.

This application claims priority from Japanese Patent Application No. 2004-340565 filed Nov. 25, 2004, which is hereby incorporated by reference herein.

What is claimed is:

1. A method for acquiring information concerning a mass of a constituent of a target object by using a time-of-flight mass spectrometer and acquiring information concerning a distribution state of the constituent based on the acquired mass information, the method comprising:

a step of applying an aqueous solution having a pH of 6 or less to promote ionization of the constituent;

a step of ionizing the constituent by using a primary ion beam, whereby the constituent flies;

a step of acquiring information concerning the mass of the flying constituent by using a time-of-flight mass spectrometer; and a step of acquiring information concerning the distribution state of the constituent based on the information concerning the mass of the constituent.

2. The information acquiring method according to claim 1, wherein no matrix substance is used.

3. The information acquiring method according to claim 1, wherein the constituent is a protein or a peptide.

4. The information acquiring method according to claim 1, wherein the step of applying the aqueous solution is carried out as a single treatment step so that the distribution state of the constituent can be maintained.

5. The information acquiring method according to claim 4, wherein the step of applying the aqueous solution comprises dropping a droplet of the aqueous solution discharged from a pipetter or an inkjet head onto the target object or comprises immersing the target object in the aqueous solution.

6. The information acquiring method according to claim 5, wherein the aqueous solution is a solution containing any one selected from the group consisting of trifluoroacetic acid, hydrochloric acid, nitric acid, hydrofluoric acid, acetic acid, and formic acid.

7. The information acquiring method according to claim 6, wherein the aqueous solution contains trifluoroacetic acid.

8. The information acquiring method according to claim 1, wherein the information concerning the mass of the constituent is information concerning the mass of either:

(1) an ion corresponding to a mass number of an ion generated by getting or losing 1 to 10 atoms selected from hydrogen, carbon, nitrogen, oxygen, or a combination thereof for the constituent as a parent molecule; or (2) an ion corresponding to a mass number of an ion generated by attaching at least one of noble metal atoms and alkaline metal atoms, and getting or losing 1 to 10 atoms selected from hydrogen, carbon, nitrogen, oxygen, or a combination thereof for the constituent as a parent molecule.

9. The information acquiring method according to claim 1, wherein information about a two-dimensional distribution state of the constituent is obtained by scanning of the primary beam based on the information acquired from the flying constituent.

10. The information acquiring method according to claim 1, wherein a two-dimensional distribution state of the constituent is not changed in the step of applying the aqueous solution.

* * * * *